United States Patent [19]

Verwimp et al.

[11] 4,316,124

[45] Feb. 16, 1982

[54] MIXED LIGHT ARRANGEMENT

[75] Inventors: Jozef K. P. Verwimp; Gabriël Deloddere, both of Eindhoven, Netherlands

[73] Assignee: U.S. Philips Corporation, New York, N.Y.

[21] Appl. No.: 78,524

[22] Filed: Sep. 24, 1979

[30] Foreign Application Priority Data

Oct. 2, 1978 [NL] Netherlands ..... 7809907

[51] Int. Cl.[3] ..... H05B 41/16; H01J 61/56; H01J 61/96

[52] U.S. Cl. ..... 315/205; 315/49; 315/179; 315/188; 315/208; 315/241 R

[58] Field of Search ..... 315/49, 179, 187, 188, 315/193, 205, 208, 240, 241 R

[56] References Cited

U.S. PATENT DOCUMENTS 3,527,982 9/1970 Lake ..... 315/179 X 3,666,986 5/1972 Lake et al. ..... 315/205 X

*Primary Examiner*—Eugene R. La Roche

*Attorney, Agent, or Firm*—Bernard Franzblau

[57] ABSTRACT

The invention relates to a mixed light lamp arrangement intended to be connected to an a.c. power supply. The lamp arrangement comprises a rectifier bridge having output terminals interconnected by the mixed light combination consisting of a series arrangement of an incandescent filament and a discharge tube. The series arrangement is shunted by a branch comprising a capacitor and an anti-parallel arrangement of a diode and a thyristor with the thyristor being rendered conductive just prior to the end of each half cycle of the a.c. power supply. This results in a mixed light lamp wherein the capacitance of the capacitor can have a relatively low value and the luminous efficacy can be relatively high.

6 Claims, 2 Drawing Figures

MIXED LIGHT ARRANGEMENT

Figure 1:
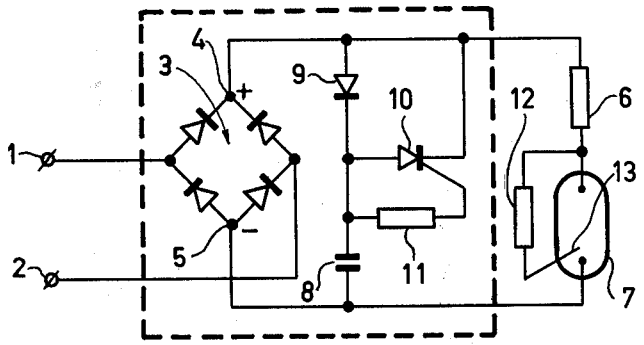

The invention relates to a mixed light arrangement comprising two input terminals intended to be connected to an a.c. voltage source the frequency of which is below 100 Hz, and a rectifier bridge having its inputs respectively connected to said terminals and its outputs interconnected by a series arrangement of an incandescent filament and a discharge tube, this series arrangement being shunted by a branch comprising a capacitor.

A known mixed light arrangement of the above-mentioned type is, for example, disclosed in U.S.A. Pat. No. 3,527,982. A drawback of that known arrangement is that the capacitor has a relatively large capacitance and, consequently, a large volume. In the known arrangement the capacitor has to be located in an accessory which does not form a part of a mixed light lamp.

It is an object of the invention to provide a mixed light arrangement of the above-mentioned type wherein the capacitance of the capacitor can be relatively low.

According to the invention there is provided a mixed light arrangement comprising two input terminals, intended to be connected to an a.c. voltage source, the frequency of which is below 100 Hz, and a rectifier bridge having its inputs respectively connected to said terminals and the outputs interconnected by a series arrangement of an incandescent filament and a discharge tube. The series arrangement is shunted by a branch comprising a capacitor. The invention is characterized in that a controlled rectifier arranged in antiparallel with a non-controlled rectifier is present in the said branch in series with the capacitor and that the controlled rectifier has a control circuit which renders the controlled rectifier conductive towards the end of each half cycle of the a.c. voltage source in the operating condition of the mixed light arrangement.

Such a mixed light arrangement has the advantage that the capacitance of the capacitor can be lower than that of the capacitor of the above-mentioned known arrangement.

This can be explained as follows. In a mixed light arrangement according to the invention the voltage rectified in a full-wave manner by the rectifying bridge is applied to the mixed light combination consisting of the series arrangement of the filament and the discharge tube. In addition, from the beginning of each half cycle of the a.c. voltage source onwards the capacitor present in the branch shunting the mixed light combination is charged via the non-controlled rectifier. Just prior to the end of the relevant half cycle the controlled rectifier is rendered conductive by means of its control circuit. The capacitor then discharges across the mixed light combination. The discharge current of the capacitor fills a portion of the "valley" of the current wave form. Thus the capacitance of the capacitor can be relatively low owing to the fact that the capacitor needs to supply a discharge current for a short period of time only, i.e. during the transition from one half cycle to the next half cycle, this transition being critical for the discharge in the discharge tube.

Filling the valley in the current waveform has the additional advantage that it makes it possible to choose the arc voltage of the discharge tube to be relativley high, in spite of the low-value capacitor, without the occurrence of re-starting problems in the discharge tube in the transition from one half cycle to the next half cycle. A higher arc voltage of the discharge tube means that, at a constant value of the voltage of the a.c. voltage supply, a greater portion of the light generation is produced by the discharge tube and a smaller portion by the filament. As a discharge tube is, as a rule, a more efficient light generator than a filament, this results in a higher luminous efficacy of the mixed light arrangement.

The controlled rectifier may, for example, be a transistor which can be cut off again after the capacitor has discharged.

The control circuit of the controlled rectifier of a mixed light arrangement according to the invention may be provided with, for example, a supply source of its own, for example a battery, which periodically renders the controlled rectifier conductive by means of an auxiliary switch. In a currently preferred embodiment of a mixed light arrangement according to the invention, however, the controlled rectifier is a thyristor and the control circuit of that thyristor consists of a resistor arranged between the anode and a control electrode of that thyristor. This embodiment has the advantage that the control circuit is simple and that the controlled rectifier is automatically made non-conductive at the end of the capacitor discharge. The anode of the thyristor becomes positive relative to its cathode in the second half of a half cycle of the a.c. power supply. If a certain difference in potential is achieved between those electrodes of the thyristor a current will flow through said resistor to render the thyristor conductive. Towards the end of the discharge of the capacitor, the current through the thyristor decreases to a level below its hold current value and the thyristor is rendered non-conductive again.

In a further currently preferred embodiment of a mixed light arrangement according to the invention the arrangement is implemented as a mixed light lamp. This has the advantage that no circuit components, such as, for example, the capacitor of the arrangement, need be fitted separately from the lamp. The circuit components are, for example, all arranged in the lamp cap or partly between the discharge tube and an outer bulb enveloping this tube.

It is primarily due to the fact that a relatively low value capacitor can be used in an arrangement according to the invention that makes it possible to realize the arrangement of a mixed light lamp with acceptable dimensions.

Figure 2:
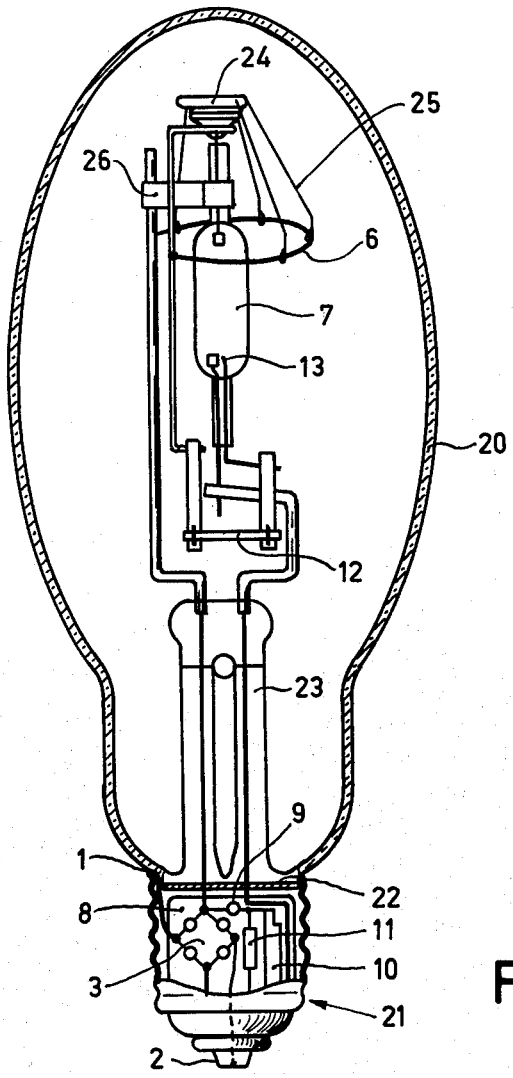

An embodiment of the invention will now be further described with reference to the accompanying drawing, wherein:

FIG. 1 shows a circuit diagram of a mixed-light arrangement according to the invention; and FIG. 2 shows a longitudinal cross-section, partly elevational view, of a mixed light lamp provided with an electric circuit in accordance with the diagram of FIG. 1.

In FIG. 1 two input terminals 1 and 2, which are intended to be connected to an a.c. voltage source of approximately 220 V, 50 Hz, are respectively connected to the inputs of a rectifier bridge 3. A series arrangement of an incandescent filament 6 and a discharge tube 7 is connected to the outputs 4 and 5 of the bridge. The tube 7 is a high-pressure mercury vapour discharge tube. Said series arrangement 6,7 is shunted by a series arrangement of a capacitor 8 and an anti-parallel arrangement of a diode 9 and a thyristor 10. Thyristor 10 is controlled by means of a resistor 11 arranged between its anode and control electrode. An internal auxiliary electrode 13 of the discharge tube 7 is connected to a junction between the filament 6 and the discharge tube 7 via a resistor 12. If so desired, a bi-metal switch which is closed in the cold state and opened in the operating condition of the lamp may be connected between said junction and the auxiliary electrode 13. Consequently, the bimetal switch keeps the auxiliary electrode in its switched-off state, in the operating condition of the lamp.

The arrangement operates as follows. In the operating conditon of the lamp the capacitor 8 is charged via the rectifier bridge 3 and the diode 9 at the beginning of each half cycle of the a.c. power supply. Simultaneously a current flows through the series arrangement of the filament 6 and the discharge tube 7. Just prior to the end of each half cycle the thyristor 10 is rendered conductive through the resistor 11. As a result the capacitor 8 discharges across the filament 6 and the discharge tube 7. This produces an additional current through elements 6 and 7.

Towards the end of the discharge of the capacitor 8 the current through the thyristor 10 decreases to below its hold current value, which causes the thyristor to become non-conductive. At the beginning of the next half cycle the capacitor 8 is charged again through the diode 9, etc.

In a practical embodiment, the capacitance of the capacitor 8 is approximately 2.2 $\mu$F. The resistor 11 is approximately 82 kOhm, and the resistor 12 approximately 20 kOhm. The current through the series arrangement of the filament 6 and the discharge tube 7 is approximately 790 milliamps. The voltage across the filament 6 is approximately 125 V and across the discharge tube 7 approximately 122 V. The total lamp power is approximately 164 Watt and the luminous efficacy approximately 25.4 Lumen/Watt.

The fact that capacitor 8 has a relatively low value, and hence is small in size, enables the whole assembly of the components enclosed within the broken outline in FIG. 1 to be housed in the lamp cap of an otherwise conventional mixed lamp in the manner shown in FIG. 2. The reference numerals in FIG. 2 correspond to those of FIG. 1.

The mixed-light lamp shown in FIG. 2 has an overall length of approximately 18 cm. An outer bulb 20, provided with a luminescent layer, has a largest diameter of approximately 7.5 cm and is provided with a lamp cap 21 which houses all the components shown enclosed in FIG. 1. A mica plate 22 shields the circuit components in the lamp cap 21 from the heat generated—in addition to the generation of light—within the outer bulb 20. Reference numeral 23 is a glass stem provided with an exhaust tube. A bead 24 supports the filament 6 by means of supporting wires such as 25. The extended portion 26 of a pole wire serves to support the discharge tube 7.

The discharge lamp can be connected directly to the above-mentioned 220 Volts, 50 Hz power supply.

What is claimed is:

1. A mixed-light arrangement comprising two input terminals for connection to an a.c. voltage source having a frequency below 100 Hz, a rectifier bridge having inputs respectively connected to said input terminals and outputs interconnected by a series arrangement of an incandescent filament and a discharge tube, the series arrangement being shunted by a branch comprising a capacitor connected in series with a rectifier and a controlled rectifier connected in anti-parallel, and a control circuit coupled to the controlled rectifier which renders the controlled rectifier conductive towards the end of each half cycle of the a.c. voltage source in the operating condition of the mixed light arrangement.

2. A mixed light arrangement as claimed in claim 1 wherein the controlled rectifier comprises a thyristor and the control circuit of the thyristor includes a resistor arranged between the anode and a control electrode of the thyristor.

3. A mixed light arrangement as claimed in claim 1, wherein the discharge tube comprises a dual envelope lamp having an outer envelope housing an electric discharge lamp and said filament and a base member fastened to the outer envelope and housing said rectifier bridge, said controlled rectifier and the control circuit therefor, and said capacitor.

4. A mixed light arrangement comprising, a pair of input terminals for connection to a source of AC voltage, an electric discharge tube, an incandescent filament member connected in series circuit with the discharge tube, a rectifier circuit coupling said series circuit to said input terminals, a capacitor, a diode, a controlled rectifier, means connecting the capacitor in series with an anti-parallel arrangement of the diode and the controlled rectifier in a branch circuit that shunts at least the discharge tube, and a control circuit coupled to a control electrode of the controlled rectifier for making the controller rectifier conduct toward the end of each half-cycle of the AC voltage source in the operating condition of the discharge tube.

5. A mixed light arrangement as claimed in claim 4, wherein the discharge tube comprises a dual envelope lamp having an outer envelope housing an electric discharge lamp and said filament member and a base member fastened to the outer envelope and housing said rectifier circuit, said controlled rectifier and the control circuit therefor, and said capacitor.

6. A mixed light arrangement as claimed in claim 4, wherein the rectifier circuit comprises a diode bridge circuit and the control circuit comprises a resistor connected between said control electrode and an anode of the controlled rectifier, and wherein said branch circuit shunts the series circuit comprising the filament member and the discharge tube.

* * * * *